US011430324B2

(12) United States Patent
Jonsson et al.

(10) Patent No.: US 11,430,324 B2
(45) Date of Patent: Aug. 30, 2022

(54) CONTROLLING OPERATIONAL STATE OF A SENSOR DEVICE FOR BREAK-IN DETECTION

(71) Applicant: ASSA ABLOY AB, Stockholm (SE)

(72) Inventors: Tomas Jonsson, Rönninge (SE); Mats Cederblad, Hässelby (SE); Per Mackegård, Solna (SE); Stefan Johansson, Stockholm (SE)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 17/285,842

(22) PCT Filed: Oct. 25, 2019

(86) PCT No.: PCT/EP2019/079281
§ 371 (c)(1),
(2) Date: Apr. 15, 2021

(87) PCT Pub. No.: WO2020/089121
PCT Pub. Date: May 7, 2020

(65) Prior Publication Data

US 2021/0383678 A1 Dec. 9, 2021

(30) Foreign Application Priority Data

Oct. 31, 2018 (SE) ..... 1851358-0

(51) Int. Cl.
*G08B 29/26* (2006.01)
*G08B 13/02* (2006.01)
(Continued)

(52) U.S. Cl.
CPC ..... *G08B 29/26* (2013.01); *G08B 13/02* (2013.01); *G08B 13/08* (2013.01); *G08B 13/1436* (2013.01); *G08B 21/182* (2013.01)

(58) Field of Classification Search
CPC ..... G08B 29/26; G08B 13/02; G08B 21/182; G08B 13/08; G08B 13/1436
See application file for complete search history.

(56) References Cited

U.S. PATENT DOCUMENTS 3,680,047 A 7/1972 Perlman
5,552,763 A 9/1996 Kirby
(Continued)

FOREIGN PATENT DOCUMENTS

CN 102637337 8/2012
CN 203276445 11/2013
(Continued)

OTHER PUBLICATIONS

Official Action for Sweden Patent Application No. 1851358-0, dated May 6, 2019, 8 pages.
(Continued)

*Primary Examiner* — John A Tweel, Jr.
(74) *Attorney, Agent, or Firm* — Sheridan Ross P.C.

(57) ABSTRACT

A method is provided for controlling an operational state of a sensor device for break-in detection. The method is performed in the sensor device and comprises the steps of: determining, while in a low-power state, that a wake-up condition is true when a vibration measurement associated with a barrier is greater than a wake-up threshold; transitioning, when the wake-up condition is true, to an active state; determining, while in the active state, when an activity condition is true, the activity condition being based on vibration measurements associated with the barrier; increasing the wake-up threshold, and transitioning to the low-power state when the activity condition is not determined to be true within a first duration while in the active state; and decreasing the wake-up threshold, when the sensor device stays in the low-power state longer than a second duration.

11 Claims, 3 Drawing Sheets

(51) Int. Cl.

| | |
|---|---|
| ***G08B 21/18*** | (2006.01) |
| ***G08B 13/14*** | (2006.01) |
| ***G08B 13/08*** | (2006.01) |

(56) References Cited

U.S. PATENT DOCUMENTS

| | | | | |
|---|---|---|---|---|
| 6,538,570 | B1 * | 3/2003 | Smith | G08B 13/04 340/550 |
| 7,388,487 | B2 * | 6/2008 | Smith | B60R 25/1009 340/426.27 |
| 10,089,851 | B1 | 10/2018 | Singh | |
| 10,403,119 | B2 * | 9/2019 | Seelman | G08B 21/182 |
| 10,977,912 | B2 * | 4/2021 | Zhang | G08B 13/04 |
| 2006/0273896 | A1 | 12/2006 | Kates | |
| 2009/0177359 | A1 | 7/2009 | Ihara et al. | |
| 2013/0335219 | A1 | 12/2013 | Malkowski | |
| 2015/0015401 | A1 | 1/2015 | Wedig et al. | |
| 2016/0086460 | A1 | 3/2016 | King et al. | |
| 2016/0116343 | A1 | 4/2016 | Dixon et al. | |
| 2016/0189531 | A1 | 6/2016 | Modi et al. | |
| 2018/0263573 | A1 | 9/2018 | Riistama et al. | |
| 2020/0388123 | A1 * | 12/2020 | Jonsson | G08B 13/1654 |

FOREIGN PATENT DOCUMENTS

| | | |
|---|---|---|
| CN | 108615340 | 10/2018 |
| EP | 1522981 | 4/2005 |
| JP | H08-254459 | 10/1996 |
| JP | 2008-094119 | 4/2008 |

OTHER PUBLICATIONS

International Search Report and Written Opinion for International (PCT) Patent Application No. PCT/EP2019/079281, dated Jan. 7, 2020, 12 pages.

Cao et al. "Alarm threshold verification and related adjustment strategy of WDF and WPC channels in sysmex XN-3000 hematology analyzer," Chinese Journal of Clinical Laboratory Science, 2018, vol. 12, pp. 166-170 (Abstract only).

English Translation of Official Action for China Patent Application No. 201980069934.1, dated Feb. 23, 2022, 8 pages.

Official Action for Australia Patent Application No. 2019370846, dated Feb. 4, 2022, 3 pages.

* cited by examiner

CONTROLLING OPERATIONAL STATE OF A SENSOR DEVICE FOR BREAK-IN DETECTION

CROSS REFERENCE TO RELATED APPLICATIONS

This application is a national stage application under 35 U.S.C. 371 and claims the benefit of PCT Application No. PCT/EP2019/079281 having an international filing date of Oct. 25, 2019, which designated the United States, which PCT application claimed the benefit of Sweden Patent Application No. 1851358-0 filed Oct. 31, 2018, the disclosure of each of which are incorporated herein by reference.

TECHNICAL FIELD

The invention relates to a method, a sensor device, a computer program and a computer program product for controlling operational state of a sensor device for break-in detection.

BACKGROUND

Unfortunately, it is a continuous problem with break-ins and burglaries in homes and commercial properties. There are a number of sensors in the prior art to detect such break-ins. Some sensors detect when a window or door is opened or glass is broken and other sensors detect movement.

One type of such sensor is based on accelerometers. These are used for detecting vibrations that occur when a break-in attempt occurs. In this way, an alarm can be raised prior to major structural damage occurring. Some of these solutions claim to be able to differentiate between a ball bounce or knock on a door and an attempted break-in.

However, it is very difficult to find the balance between an acceptable activity and a break-in. False alarms are very stressful and result in undermined trust of the alarm system. On the other hand, a missed detection of a break-in is even worse, since the whole point of such a sensor is to detect break-ins.

SUMMARY

According to a first aspect, a method for controlling an operational state of a sensor device for break-in detection is provided. The method is performed in the sensor device and comprises the steps of: determining, while in a low-power state, that a wake-up condition is true when a vibration measurement associated with a barrier is greater than a wake-up threshold; transitioning, when the wake-up condition is true, to an active state; determining, while in the active state, when an activity condition is true, the activity condition being based on vibration measurements associated with the barrier; increasing the wake-up threshold, and transitioning to the low-power state when the activity condition is not determined to be true within a first duration while in the active state; and decreasing the wake-up threshold, when the sensor device stays in the low-power state longer than a second duration.

The method may further comprise the step of: decreasing the wake-up threshold and transitioning to the low-power state when receiving a signal indicating a false alarm.

The signal indicating a false alarm may be based on user input.

The second duration may be configurable by a user.

The activity condition may be a break-in alarm.

The step of transitioning to the active state may comprise transitioning via a measure state in which measurements are sampled with greater frequency than in the low-power state while a processor of the sensor device is still sleeping.

According to a second aspect, it is provided a sensor device for controlling its operational state for break-in detection. The sensor device comprises: a processor; and a memory storing instructions that, when executed by the processor, cause the sensor device to: determine, while in a low-power state, that a wake-up condition is true when a vibration measurement associated with a barrier is greater than a wake-up threshold; transition, when the wake-up condition is true, to an active state; determine, while in the active state, when an activity condition is true, the activity condition being based on vibration measurements associated with the barrier; increase the wake-up threshold, and transitioning to the low-power state when the activity condition is not determined to be true within a first duration while in the active state; and decrease the wake-up threshold, when the sensor device stays in the low-power state longer than a second duration.

The sensor device may further comprise instructions that, when executed by the processor, cause the sensor device to: decrease the wake-up threshold and transitioning to the low-power state when receiving a signal indicating a false alarm.

The signal indicating a false alarm may be based on user input.

The second duration may be configurable by a user.

According to a third aspect, it is provided a computer program for controlling operational state of a sensor device for break-in detection. The computer program comprises computer program code which, when run on a sensor device causes the sensor device to: determine, while in a low-power state, that a wake-up condition is true when a vibration measurement associated with a barrier is greater than a wake-up threshold; transition, when the wake-up condition is true, to an active state; determine, while in the active state, when an activity condition is true, the activity condition being based on vibration measurements associated with the barrier; increase the wake-up threshold, and transitioning to the low-power state when the activity condition is not determined to be true within a first duration while in the active state; and decrease the wake-up threshold, when the sensor device stays in the low-power state longer than a second duration.

According to a fourth aspect, it is provided a computer program product comprising a computer program according to the third aspect and a computer readable means on which the computer program is stored.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Embodiments herein provide an automatic adjustment of a wake-up threshold, controlling the sensitivity of when a sensor device transitions from a wake-up state to a measurement state. The wake-up threshold is decreased when there is no wake-up for a long period of time. On the other hand, the wake-up threshold is increased when a wake-up is triggered without further activity being detected. In this way, the sensor device adapts to its environment and balances responsiveness and power use without any user involvement.

Figure 1:
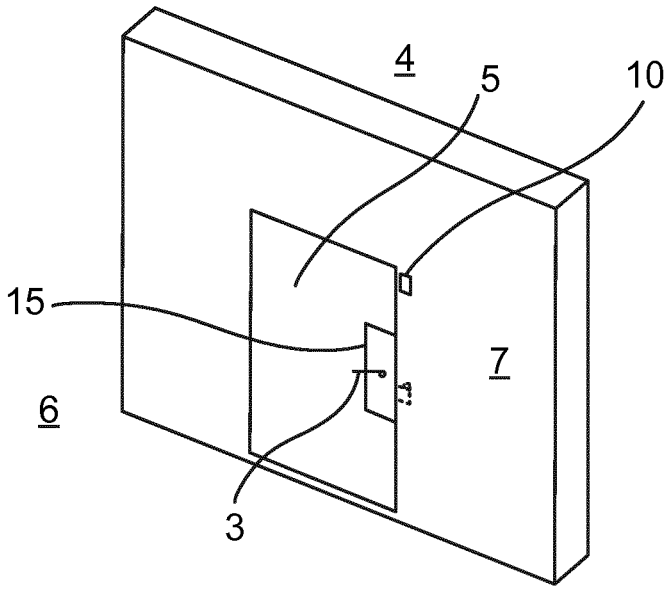
FIG. 1 is a schematic diagram showing an environment in which embodiments presented herein can be applied.

FIG. 1 is a schematic diagram showing an environment in which embodiments presented herein can be applied. Access to a physical space 6 is restricted by a physical barrier 5 which is selectively controlled to be in a locked state or an unlocked state. The physical barrier 5 can be a door, window, gate, hatch, cabinet door, drawer, etc. The physical barrier 5 is provided in a surrounding structure 7 (being a wall, fence, ceiling, floor, etc.) and is provided between the restricted physical space 6 and an accessible physical space 4. It is to be noted that the accessible physical space 4 can be a restricted physical space in itself, but in relation to this physical barrier 5, the accessible physical space 4 is accessible. A handle 3 is provided on the barrier to allow a person to open and close the barrier.

In order to unlock the barrier 5, a lock 15 is provided. The lock 15 can be a traditional mechanical lock or an electronic lock. It is to be noted that the lock 15 can be provided in the physical barrier 5 as shown or in the surrounding structure 7 (not shown).

A sensor device 10 comprising an accelerometer is provided to detect vibrations in a structure of the building. The accelerometer 10 can detect vibrations in three geometric dimensions (X, Y and Z), thus providing a vibration signal containing the three components corresponding to the three geometric dimensions. The structure in which vibrations are detected can be the barrier 5 and/or surrounding structure 7. The sensor device 10 can be a separate device as shown here, or the sensor device can e.g. form part of the lock 15. Alternatively, the sensor device can be provided in or by a striking plate.

Figure 2:
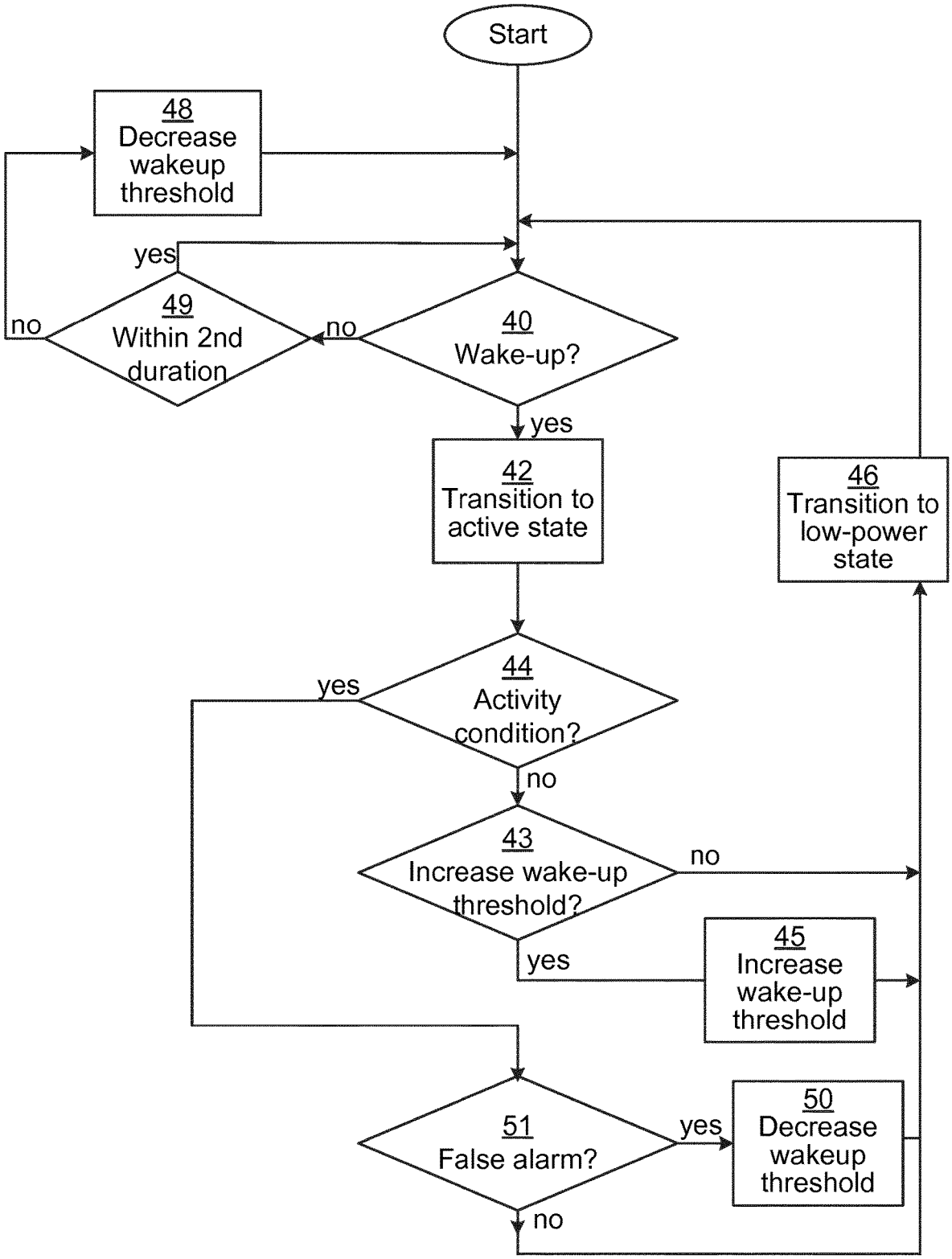
FIG. 2 is a flow chart illustrating embodiments of methods performed in the sensor device for controlling operational state of the sensor device for break-in detection.
Figure 3:
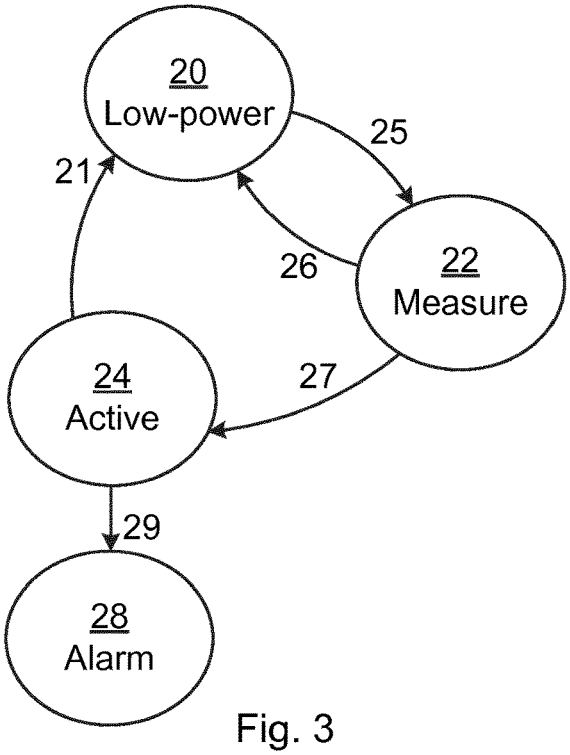
FIG. 3 is a state diagram illustrating various states of the sensor device.

FIG. 2 is a flow chart illustrating embodiments of methods performed in the sensor device for controlling operational state of the sensor device for break-in detection and FIG. 3 is a state diagram illustrating various operational states, hereinafter denoted states, of the sensor device. Functions of the sensor device will be described now with reference both to the flow chart of FIG. 2 and the state diagram of FIG. 3.

When the method starts, the sensor device is in a low-power state 20. In this state, the processor (e.g. MCU (microcontroller unit)) can be switched off and vibrations are sampled with low frequency to preserve power.

In a conditional wake-up step 40, the sensor device determines, while in a low-power state 20, that a wake-up condition is true when a vibration measurement associated with a barrier is greater than a wake-up threshold. This vibration measurement can e.g. be a strength of vibration or a length of vibration or a combination of both. The wake-up threshold is obtained using measurements from an accelerometer of the sensor device, which is detected while in the low-power state 20 in this step. When the wake-up condition is true, the method proceeds to a transition to an active state step 42. Otherwise, the method proceeds to a conditional within $2^{nd}$ duration step 49.

It is to be noted that the conditional wake-up step 40 can be implemented either as a polling step that is performed regularly or as a trigger step, that is performed when the wake-up condition is true. Optionally, the polling frequency is configurable and/or adaptable. For instance, if an impulse has been detected, the polling frequency can be increased for a specified time to better capture new impulses. During a break-in, there are typically several impulses and, in this way, more information can be obtained and detection is improved, without needing to increase polling frequency generally.

In a transition to active state step 42, the sensor device transitions to an active state 24, which may optionally occur via a measure state 22, i.e. first using a transition 25 from the low-power state 20 to the measure state 22. In the optional measure state 22, measurements are sampled with greater frequency than in the low-power state 20, while a processor of the sensor device 10 is still sleeping. The transition 27 from measure state 22 to active state can e.g. occur when a buffer for storing measurements in the sensor device has reached a certain level (e.g. is full). Once in the active state 24, these measurements, and new measurements coming in, are processed. When the measure state 22 is not utilised, there is a transition from the low-power state 20 to the active state 24 when the wake-up condition is true.

In the active state 24, the sensor device energises previously inactivated components, e.g. powering up the processor and potentially other components of the sensor device.

In a conditional activity condition step 44, the sensor device determines when an activity condition is true. The activity condition is based on vibration measurements associated with a barrier. For instance, the activity condition can be the detection of a break-in alarm, or that the handle of a barrier been operated to close or open the barrier.

When this step is performed, the sensor device is in the active state 24. The vibration measurement is obtained from measurements from an accelerometer of the sensor device. When the activity condition is true, this corresponds to a transition 29 in the state diagram to an alarm state 28, and the method proceeds to a conditional false alarm step 51. Otherwise, the method proceeds to an optional conditional increase wake-up threshold step 43.

In the optional conditional false alarm step 51, the sensor device receives a signal indicating a false alarm. The signal indicating a false alarm is based on user input, e.g. on a smartphone or on a control panel in the building of the barrier after an alarm condition has been detected. An alarm condition can be detected when vibrations associated with the barrier match a predetermined pattern. This matching can e.g. be based on spectrum analysis or artificial intelligence (AI). Additionally or alternatively, the vibration is determined to match the break-in when the vibrations occur for a duration longer than a duration threshold. When the alarm condition is detected, the sensor device transitions 29 from the active state 24 to an alarm state 28, where the sensor device alerts other devices of the alarm, which can result in sirens going off or other actions known in the art per se. It is at this point, that a false alarm can be indicated, e.g. by the user.

When no alarm condition is detected, the sensor device, after a certain period of time, transitions 21 from the active state 24 to the low-power state 20. In such a transition, some components, such as the processor, of the sensor device are switched off to save power.

When a false alarm is detected, the method proceeds to a decrease wake-up threshold step 50. Otherwise, the method ends. Optionally, this step also includes adjusting parameters used in detection of a break-in.

In the decrease wake-up threshold step 50, the wake-up threshold is decreased, i.e. sensitivity is increased, making it easier for a wake-up of the sensor device to be triggered.

In the conditional within $2^{nd}$ duration step 49, the sensor device determines whether it has stayed in the low-power state longer than a second duration, e.g. using a timer. If this is true, the method proceeds to a decrease wake-up threshold step 48. Otherwise, the method returns to the conditional wake-up step 40. In step 49, the sensor device is in the low-power state 20. The second duration can be user configured, e.g. to allow a target number of wake-ups per time period, such as for 24 hours.

In the decrease wake-up threshold step 48, the wake-up threshold is decreased, i.e. sensitivity is increased, making it easier for a wake-up of the sensor device to be triggered. It is to be noted that in this step, the sensor device is temporarily in an active state to allow the processing to adjust the threshold.

In the conditional increase wake-up threshold step 43, the sensor device determines whether to increase the wake-up threshold. The increase of the wake-up threshold is determined when the activity condition is not determined to be true within a first duration, i.e. no activity condition is triggered in step 44 for the sensor device within the first duration. This can be implemented using a timer or by comparing a current time with a timestamp of when the first duration started. If this is true, the method proceeds to an increase wake-up threshold step 45. Otherwise, the method proceeds to the transition to low-power state step 46.

In one embodiment, if step 43 is performed a predetermined number of times within the first duration, this results in a determination that the wake-up threshold is to be increased. This corresponds to a situation when the sensor is woken up the predetermined number of times without the activity condition being true within the first duration. In step 43, the sensor device is in the active state 24.

In the increase wake-up threshold step 45, the wake-up threshold is increased, i.e. sensitivity is decreased, making it more difficult for a wake-up of the sensor device to be triggered.

In a transition to low-power state step 46, the sensor device transitions into low-power state 20, corresponding to a transition 26 in the state diagram when the method most recently comes from step 45, or corresponding to a transition 21 in the state diagram when the method most recently comes from step 50.

Using embodiments presented herein, the sensor device automatically adapts its sensitivity according to its installed environment. When there is no activity in the low-power state for a long time (longer than the second duration), sensitivity is increased to increase responsiveness of the sensor device to vibrations which could be a break-in. On the other hand, if there is a wake-up without further activity detected within the first duration, sensitivity is decreased to prevent unnecessary wake-ups which consume power.

In this way, there is no need to set a specific sensitivity at installation, reducing requirements of skill and time at installation. Furthermore, this allows the sensor device to automatically and dynamically adapt in accordance with current conditions. For instance, conditions can change due to extreme weather such as hail storms, high winds, etc., in which case, it is beneficial if sensitivity is reduced (i.e. the wake-up threshold is increased). This will happen due to step 45 being performed when the sensor device is woken up without any further activity being detected. In another scenario, conditions will change if resident(s) of a property go away on holiday, in which case sensitivity is increased (i.e. the wake-up threshold is decreased) in step 48. When the resident(s) return to the property, the sensor device will automatically adjust to reduce sensitivity, thus reducing power usage. In this way, the sensor device is not dependent on skillful and careful configuration of thresholds by an operator, which is vulnerable to varying skill levels and changing conditions.

The use of different states achieves a balance between responsiveness of the sensor device and energy usage, which is of great importance to keep the sensor device active e.g. when powered by a battery.

Figure 4:
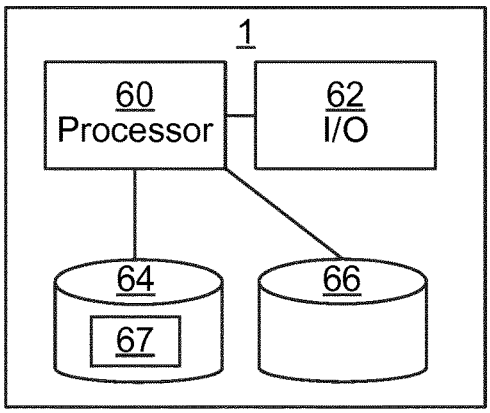
FIG. 4 is a schematic diagram illustrating components of the sensor device of FIG. 1.

FIG. 4 is a schematic diagram illustrating components of the sensor device 1 of FIG. 1. A processor 60 is provided using any combination of one or more of a suitable microcontroller unit (MCU), central processing unit (CPU), multiprocessor, digital signal processor (DSP), etc., capable of executing software instructions 67 stored in a memory 64, which can thus be a computer program product. The processor 60 could alternatively be implemented using an application specific integrated circuit (ASIC), field programmable gate array (FPGA), etc. The processor 60 can be configured to execute the method described with reference to FIG. 2 above.

The memory 64 can be any combination of random-access memory (RAM) and/or read only memory (ROM). The memory 64 also comprises persistent storage, which, for example, can be any single one or combination of solid-state memory, magnetic memory and optical memory.

A data memory 66 is also provided for reading and/or storing data during execution of software instructions in the processor 60. The data memory 66 can be any combination of RAM and/or ROM.

The sensor device 1 further comprises an I/O interface 62 for communicating with external entities, e.g. via a wireless interface such as Bluetooth or Bluetooth Low Energy (BLE), ZigBee, any of the IEEE 802.11x standards (also known as WiFi), etc. The sensor device may further contain its own power supply, such as a battery, significantly simplifying installation of the sensor device 1.

Other components of the sensor device 1 are omitted in order not to obscure the concepts presented herein.

Figure 5:
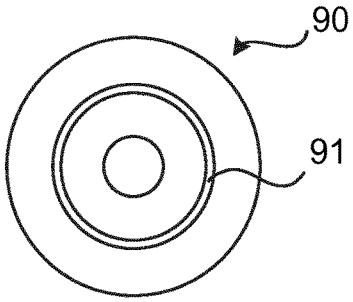
FIG. 5 shows one example of a computer program product comprising computer readable means.

FIG. 5 shows one example of a computer program product 90 comprising computer readable means. On this computer readable means, a computer program 91 can be stored, which computer program can cause a processor to execute a method according to embodiments described herein. In this example, the computer program product is an optical disc, such as a CD (compact disc) or a DVD (digital versatile disc) or a Blu-Ray disc. As explained above, the computer program product could also be embodied in a memory of a device, such as the computer program product 64 of FIG. 4. While the computer program 91 is here schematically shown as a track on the depicted optical disk, the computer program can be stored in any way which is suitable for the computer program product, such as a removable solid-state memory, e.g. a Universal Serial Bus (USB) drive.

The invention has mainly been described above with reference to a few embodiments. However, as is readily appreciated by a person skilled in the art, other embodiments than the ones disclosed above are equally possible within the scope of the invention, as defined by the appended patent claims.

What is claimed is:

1. A method for controlling operational state of a sensor device for break-in detection, the method being performed in the sensor device and comprising:

determining, while in a low-power state, that a wake-up condition is true when a vibration measurement associated with a barrier is greater than a wake-up threshold;

transitioning, when the wake-up condition is true, to an active state;

determining, while in the active state, when an activity condition is true, the activity condition being based on vibration measurements associated with the barrier;

increasing the wake-up threshold, and transitioning to the low-power state when the activity condition is not determined to be true within a first duration while in the active state; and decreasing the wake-up threshold, when the sensor device stays in the low-power state longer than a second duration.

2. The method according to claim 1, further comprising:

decreasing the wake-up threshold and transitioning to the low-power state when receiving a signal indicating a false alarm.

3. The method according to claim 2, wherein the signal indicating a false alarm is based on user input.

4. The method according to claim 1, wherein the second duration is configurable by a user.

5. The method according to claim 1, wherein the activity condition is a break-in alarm.

6. The method according to claim 1, wherein transitioning to the active state comprises transitioning via a measure state in which measurements are sampled with greater frequency than in the low-power state while a processor of the sensor device is still sleeping.

7. A sensor device for controlling its operational state for break-in detection, the sensor device comprising:

a processor; and a memory storing instructions that, when executed by the processor, cause the sensor device to:

determine, while in a low-power state, that a wake-up condition is true when a vibration measurement associated with a barrier is greater than a wake-up threshold;

transition, when the wake-up condition is true, to an active state;

determine, while in the active state, when an activity condition is true, the activity condition being based on vibration measurements associated with the barrier;

increase the wake-up threshold, and transitioning to the low-power state when the activity condition is not determined to be true within a first duration while in the active state; and decrease the wake-up threshold, when the sensor device stays in the low-power state longer than a second duration.

8. The sensor device according to claim 7, further comprising instructions that, when executed by the processor, cause the sensor device to: decrease the wake-up threshold and transitioning to the low-power state when receiving a signal indicating a false alarm.

9. The sensor device according to claim 8, wherein the signal indicating a false alarm is based on user input.

10. The sensor device according to claim 7, wherein the second duration is configurable by a user.

11. A non-transitory computer-readable medium comprising a computer program for controlling operational state of a sensor device for break-in detection, the computer program comprising computer program code which, when run on a sensor device causes the sensor device to:

determine, while in a low-power state, that a wake-up condition is true when a vibration measurement associated with a barrier is greater than a wake-up threshold;

transition, when the wake-up condition is true, to an active state;

determine, while in the active state, when an activity condition is true, the activity condition being based on vibration measurements associated with the barrier;

increase the wake-up threshold, and transitioning to the low-power state when the activity condition is not determined to be true within a first duration while in the active state; and decrease the wake-up threshold, when the sensor device stays in the low-power state longer than a second duration.

* * * * *